United States Patent [19]

Young

[11] 4,016,808

[45] Apr. 12, 1977

[54] METHOD AND APPARATUS FOR MAKING EXPANSIBLE GUSSET ENVELOPES

[76] Inventor: Louis H. Young, 401 Caranel Circle, Penn Valley, Pa. 15675

[22] Filed: Feb. 9, 1976

[21] Appl. No.: 656,094

Related U.S. Application Data

[63] Continuation-in-part of Ser. No. 603,400, Aug. 11, 1975.

[52] U.S. Cl. ..... 93/62; 93/13

[51] Int. Cl.[2] ..... B31B 29/26

[58] Field of Search ..... 93/63 M, 63 R, 62, 61 R, 93/13; 229/DIG. 3, 68 R

[56] References Cited

UNITED STATES PATENTS

| | | | |
|---|---|---|---|
| 1,580,441 | 4/1926 | Parks | 93/62 |
| 2,899,874 | 8/1959 | Normandin | 93/62 |
| 3,908,524 | 9/1975 | Shore | 93/13 X |

*Primary Examiner*—James F. Coan
*Attorney, Agent, or Firm*—Stanley Bilker

[57] ABSTRACT

Method and apparatus for fabricating expansible envelopes from a single blank by (1) inwardly folding side gusset sections between longitudinally extending triple score lines, (2) inwardly folding bottom gusset sections between transverse score lines hinging envelope front and back panels together, and (3) folding down one of the panels into glued disposition with side flaps hinged to the side gussets so that they overlie the other panel with all gussets inwardly collapsed at completion of operations. Means are also included for crimping tabs which are hinged to the ends of one of the gusset sections so that they define saddles, said saddles being tucked into the margins of the other of the gusset sections and adhered thereto as a closed corner gusset.

17 Claims, 36 Drawing Figures

A
B

FIG. 4
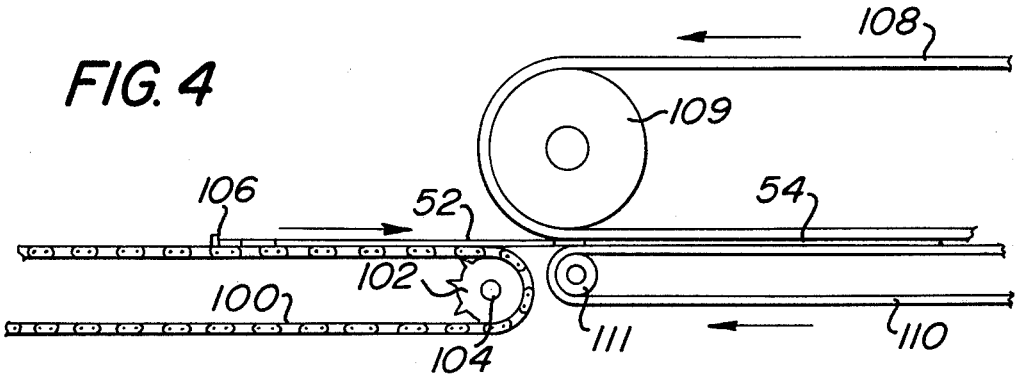
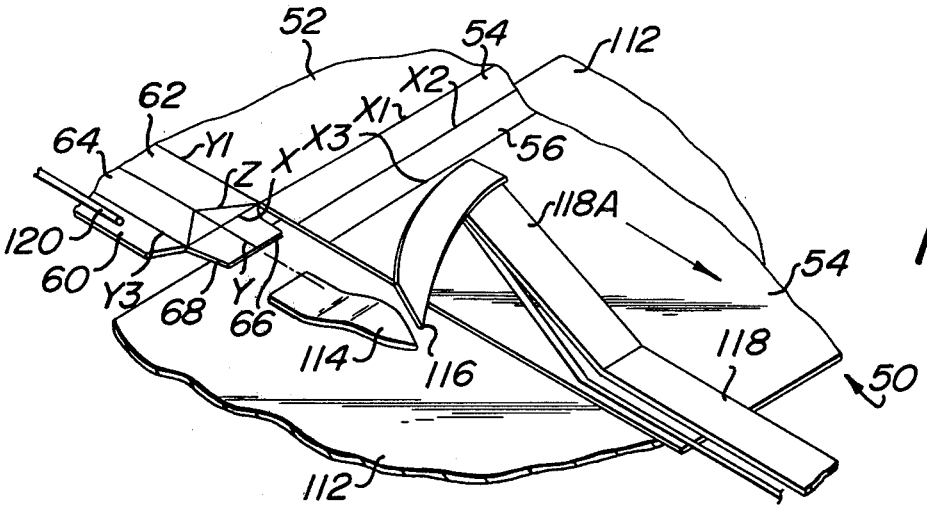
FIG. 5
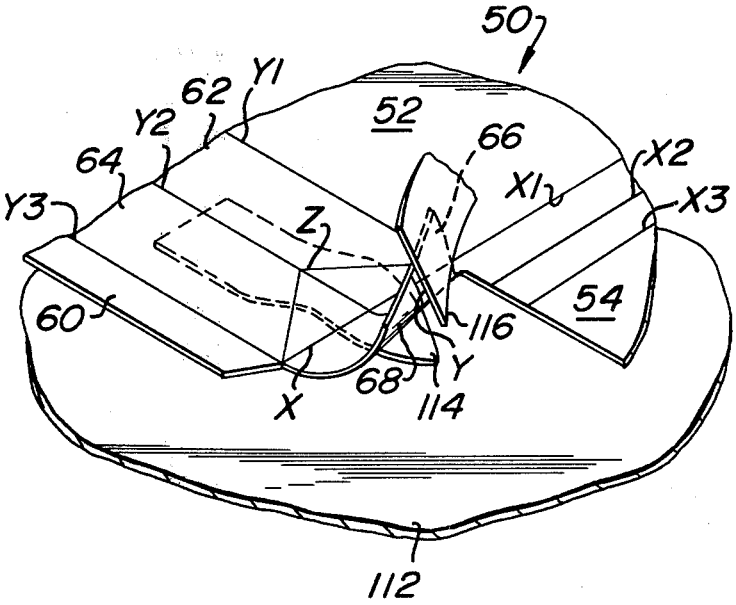
FIG. 6

FIG. 7
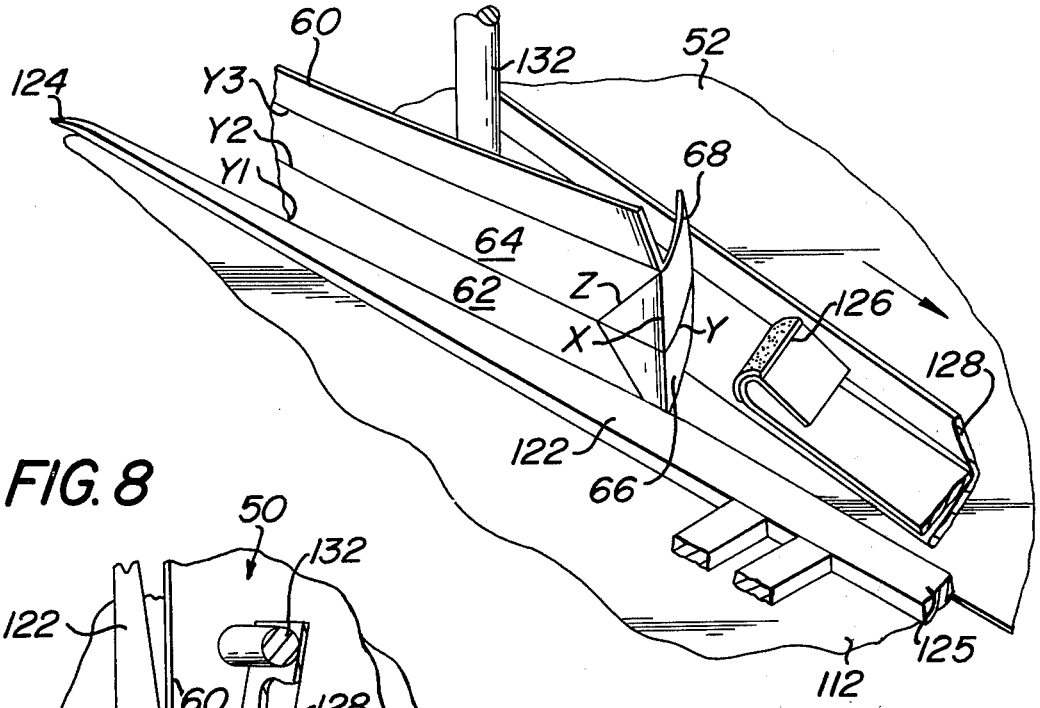
FIG. 8
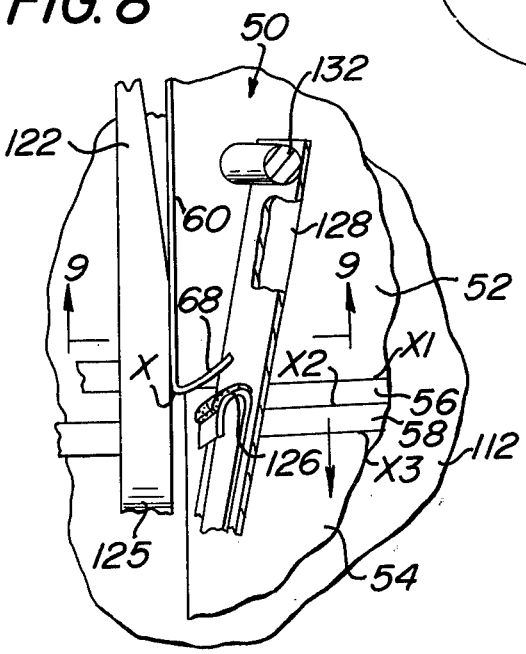
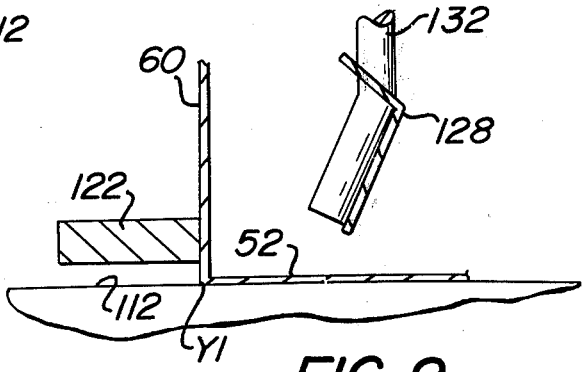
FIG. 9
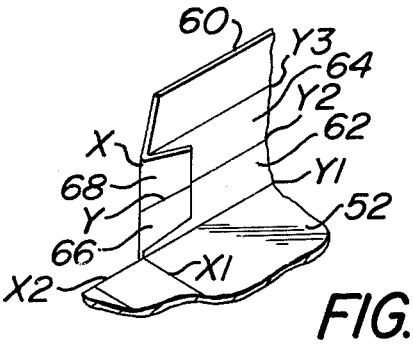
FIG. 10

FIG. 15
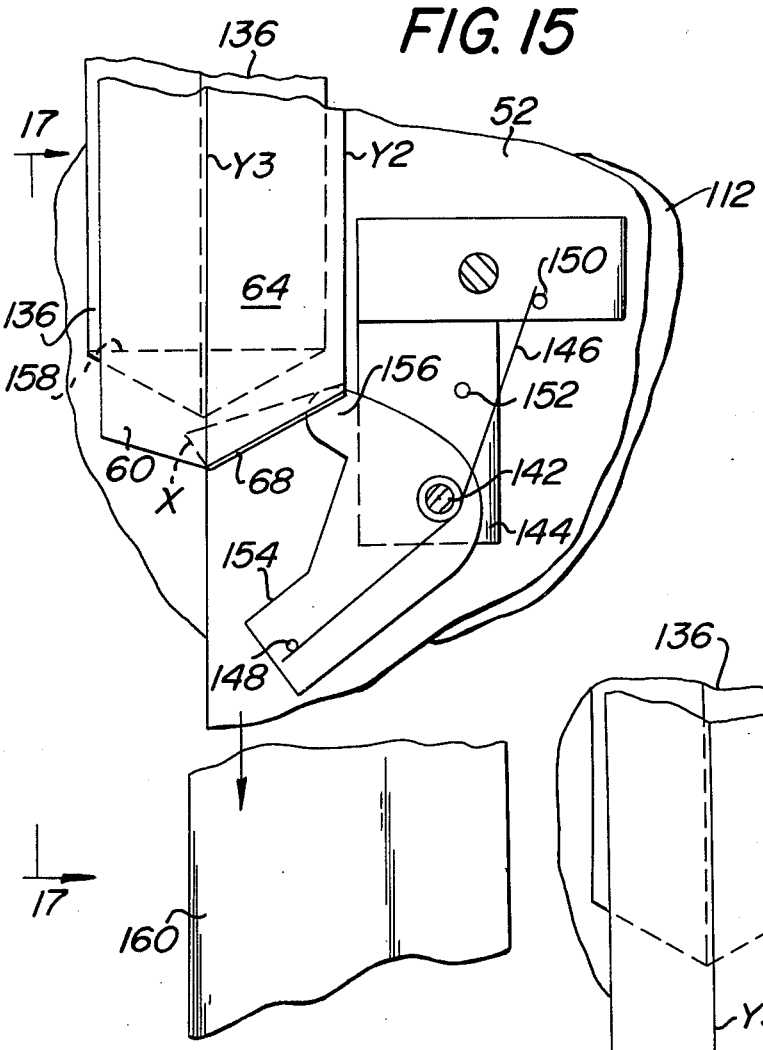
FIG. 18
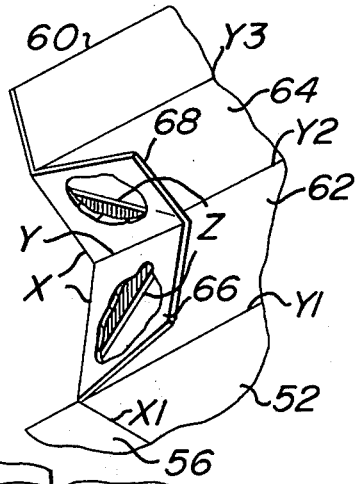
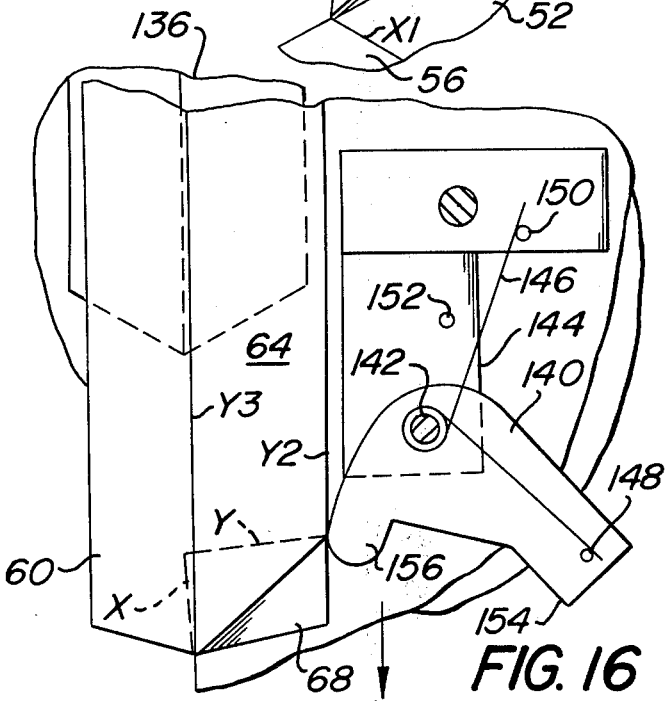
FIG. 16
FIG. 17
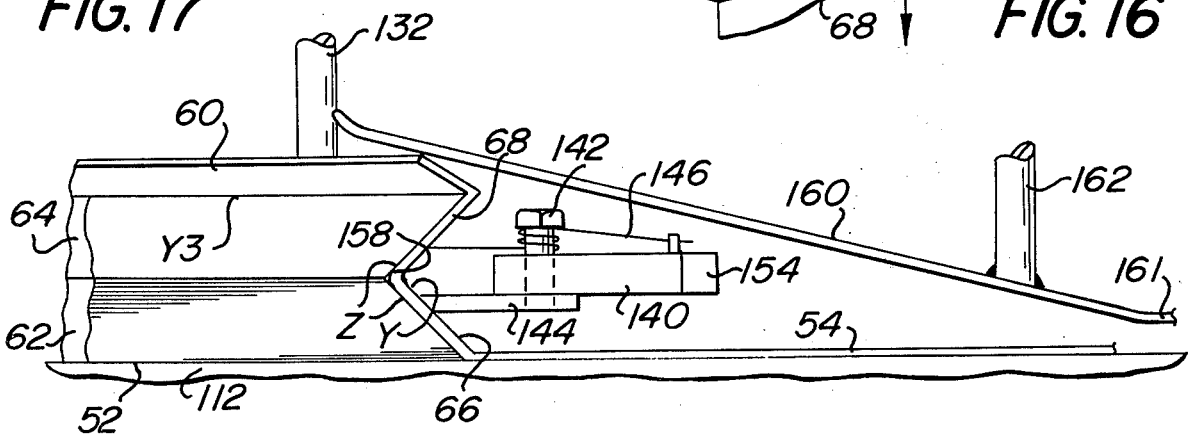

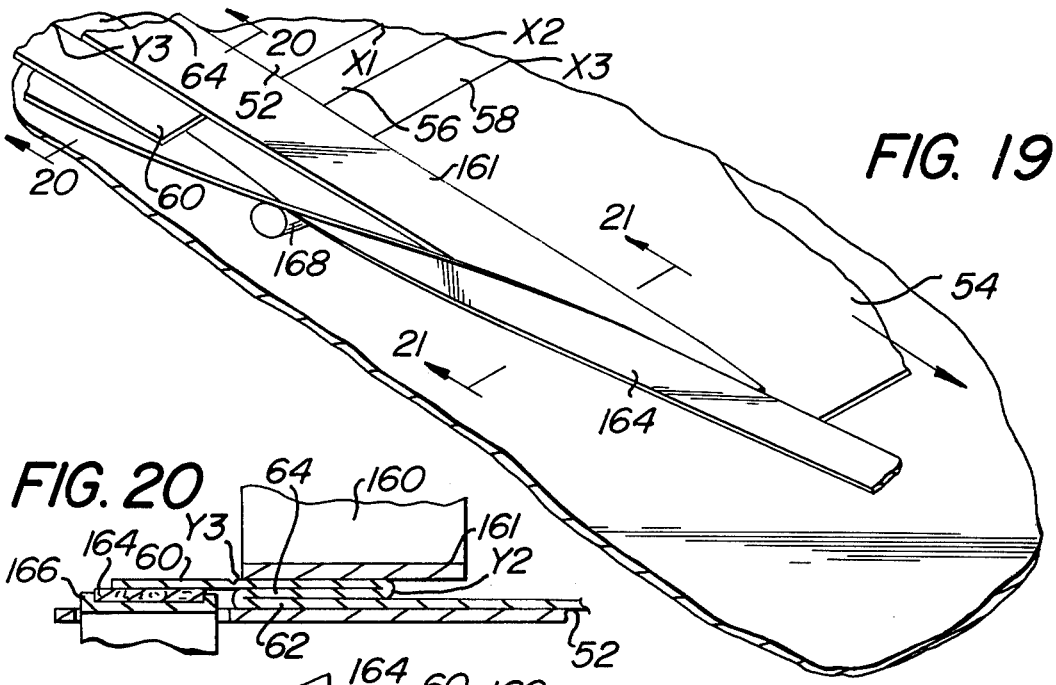
FIG. 19
FIG. 20
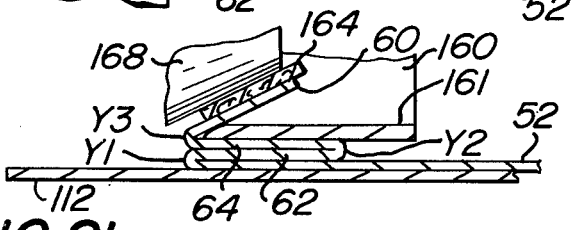
FIG. 21
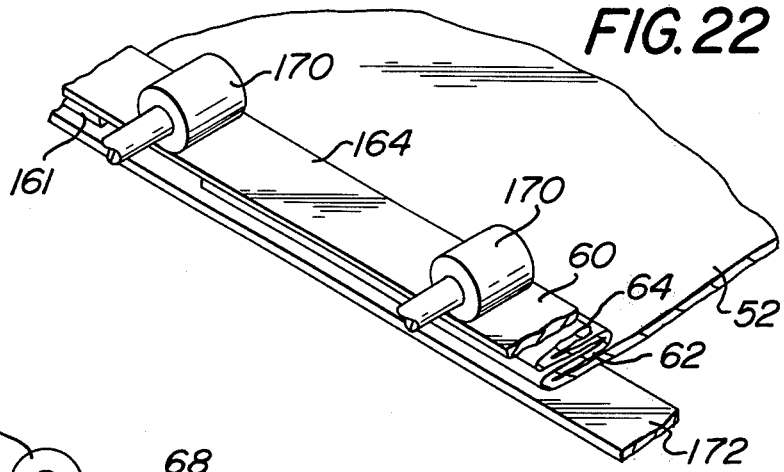
FIG. 22
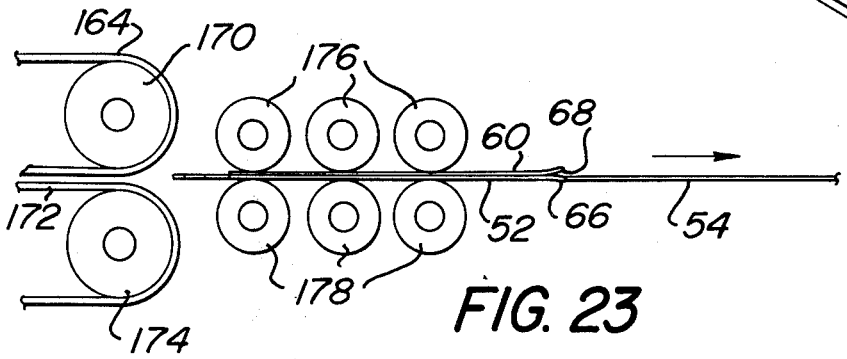
FIG. 23

FIG. 24
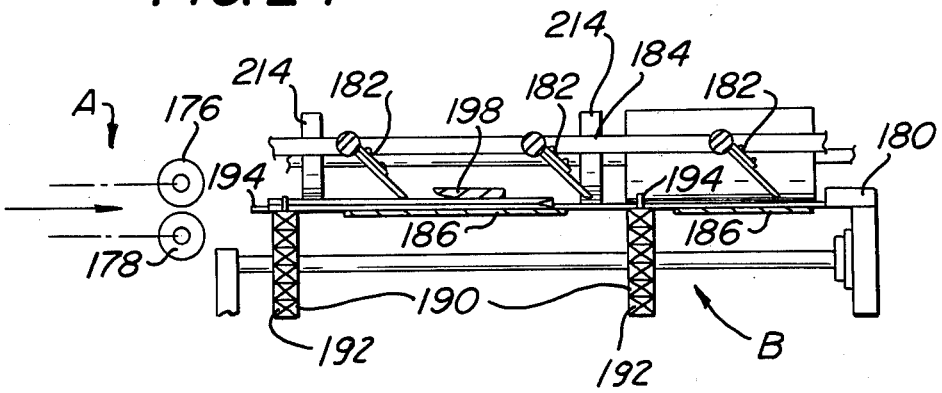
FIG. 25
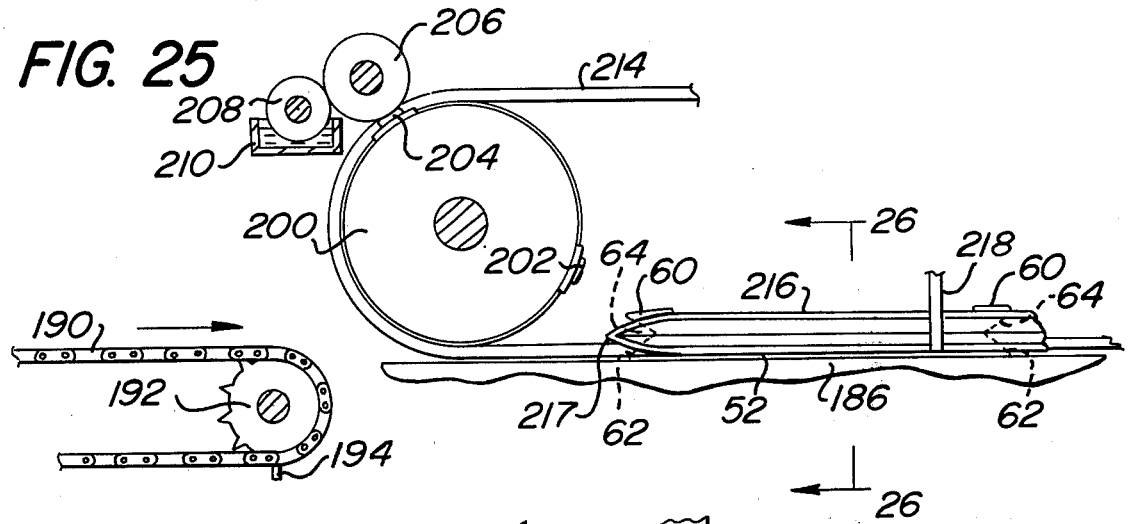
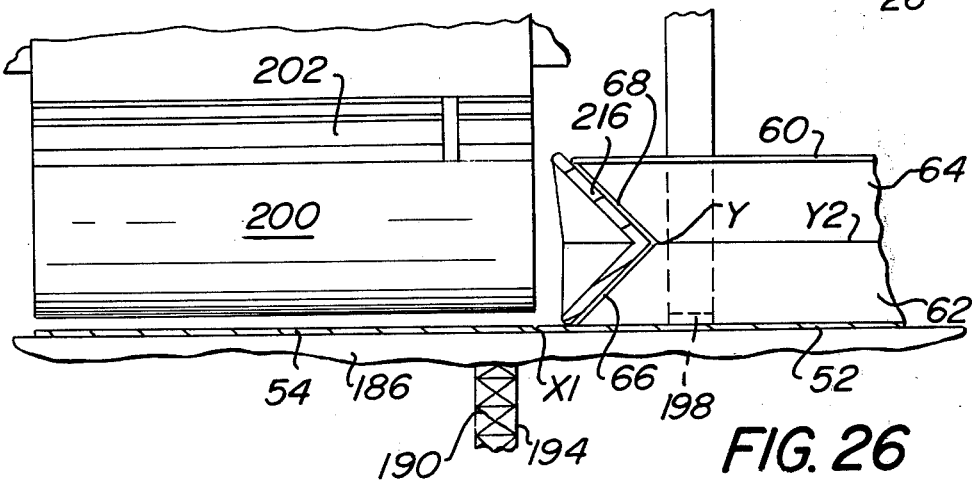
FIG. 26

FIG. 27
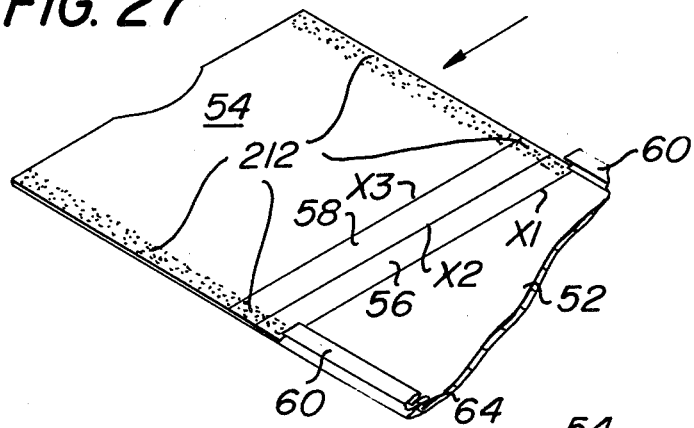
FIG. 28
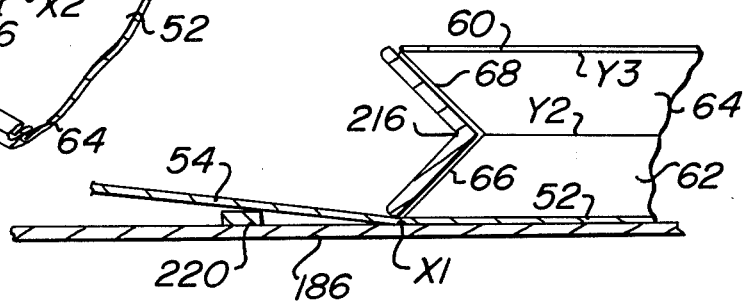
FIG. 32
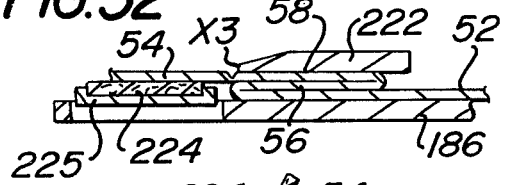
FIG. 29
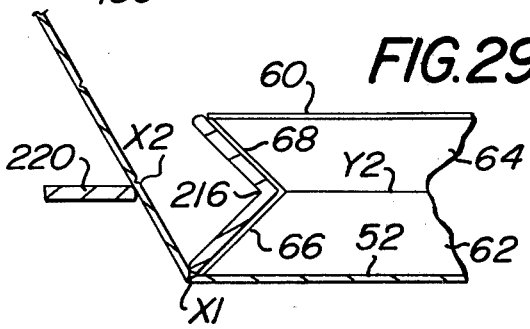
FIG. 33
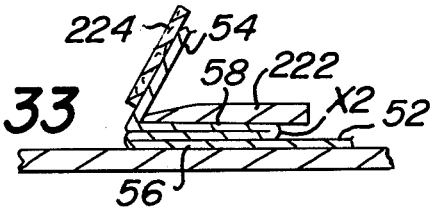
FIG. 34
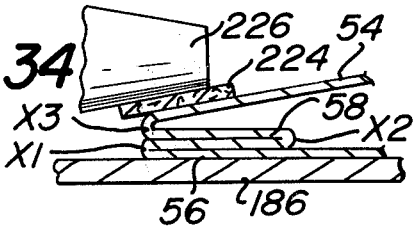
FIG. 30
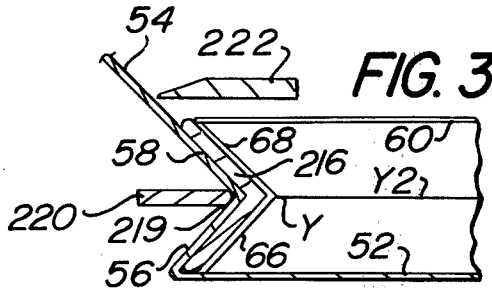
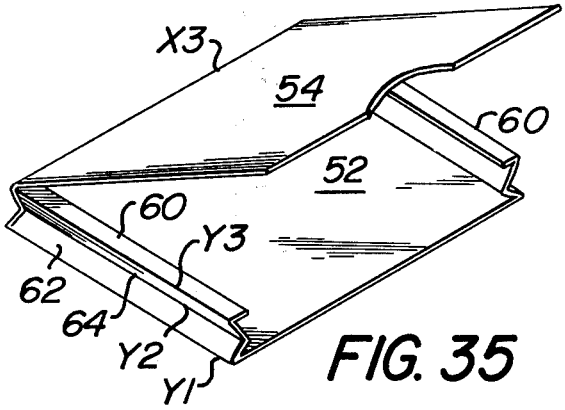
FIG. 35
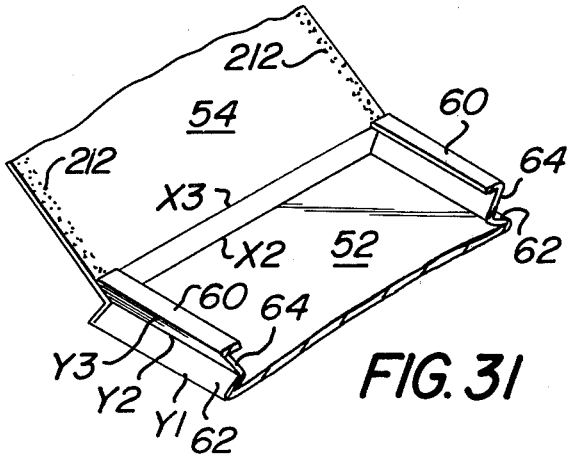
FIG. 31

METHOD AND APPARATUS FOR MAKING EXPANSIBLE GUSSET ENVELOPES

This is a continuation-in-part of my prior copending application, Ser. No. 603,400, filed Aug. 11, 1975.

This invention relates to an apparatus and method for fabricating expansible gusset envelopes. More specifically, the present invention relates to an apparatus and method for folding blanks of the general type shown in the aforesaid prior application such that upon completion of the bending and glueing operations the envelope is formed with all side and bottom gussets inwardly collapsed and having fully closed corner gussets.

In particular, the blanks with which this invention is concerned includes a pair of panels hinged together through bottom gusset sections defined between transverse triple score lines and side flaps hinged to the lateral margins of one of the panels through side gusset sections defined between longitudinal triple score lines. Each side gusset section in said blank has a tab hinged thereto along a line registering with the first of the three transverse score lines and hinged to each other along a line registering with the medial longitudinal fold line, each tab pair being detached from the next adjacent bottom gusset sections. The present invention is adapted to produce not only filing type envelopes of the general type shown in my prior copending application, Ser. No. 603,400, but also center seam style mailing envelopes of the type shown in U.S. Pat. No. 3,414,185 as well as article mailers of the side seam style shown in U.S. Pat. No. 3,552,640.

It is an object of this invention to provide an apparatus and method in which the foregoing blank is conveyed along a predetermined path wherein it is sequentially folded and glued to produce a finished envelope having all side and bottom gussets inwardly collapsed with fully closed gusset corners at completion of operations.

Another object of this invention is to provide an apparatus and method for fabricating expansible envelopes from a single blank by (1) inwardly folding side gusset sections between triple longitudinal score lines formed at the lateral edges of a first panel, (2) crimping tabs hingedly depending from the side gusset sections to form corner gussets with inwardly extending saddles, (3) inwardly folding bottom gusset sections between transverse score lines formed at the lower portion of the first panel and tucking the outer margins of said bottom gusset sections in glued disposition within the saddles, and (4) respectively folding down side flaps hinged to the side gussets and a second panel hinged to the bottom gussets into glued disposition with each other whereby they overlie the first panel with all gussets interiorly collapsed and having fully closed corners when operations are completed.

Other objects of this invention are to provide an improved device and method of the character described which is easily and economically produced, which is sturdy in construction and both highly efficient and effective in operation.

With the above and related objects in view, this invention consists of the details of construction and combination of parts as will be more fully understood from the following detailed description when read in conjunction with the accompanying drawings in which:

FIG. 4 is a side view of a feeding mechanism of this invention taken generally at the position designated by the arrow 4 in FIG. 1.

FIG. 5 is a fragmentary perspective view of a tab bending mechanism of this invention taken generally at the position designated by the arrow 5 in FIG. 1.

FIG. 6 is a fragmentary perspective view of the tab bending mechanism showing the tab being actually curled and bent back along its hinge line.

FIG. 7 is a fragmentary perspective view taken generally at the position designated by the arrow 7 in FIG. 1 and showing the first side gusset folding mechanism.

FIG. 8 is a fragmentary plan view, and partly broken away, of the folding mechanism of FIG. 7.

FIG. 9 is a sectional view taken along lines 9—9 of FIG. 8.

FIG. 10 is a fragmentary perspective view of the envelope blank per se as it is acted upon in FIG. 9.

FIG. 15 is a fragmentary plan view showing the crimping mechanism of FIG. 14 in tripped position.

FIG. 16 is a fragmentary plan view similar to FIG. 15 showing the crimping mechanism in a more advanced position. FIG. 17 is a side view taken generally along lines 17—17 of FIG. 15.

FIG. 18 is a fragmentary perspective view of the envelope blank as it is formed at the position shown in FIG. 16.

FIG. 19 is a fragmentary perspective view taken generally along the line of the arrow 19 in FIG. 1 and showing the mechanism for completing the folding of the side gussets and flaps.

FIG. 20 is a sectional view taken along lines 20—20 of FIG. 19.

FIG. 21 is a sectional view taken along lines 21—21 of FIG. 19.

FIG. 22 is a fragmentary perspective view taken generally at the position designated by the arrow 22 in FIG. 1.

FIG. 23 is a fragmentary side view taken generally at the position designated by the arrow 23 in FIG. 1 and showing the side flaps and gussets being ironed flat.

FIG. 24 is a fragmentary side view taken generally at the position designated by the arrow 24 in FIG. 1 and showing a transfer mechanism in which the direction of travel of the envelope blanks of oriented perpendicular to the original path.

FIG. 25 is a fragmentary side view taken generally at the position designated by the arrow 25 in FIG. 1 showing the glue applicator and corner saddle spreading mechanism. FIG. 26 is a sectional view taken along lines 26—26 of FIG. 25.

FIG. 27 is a fragmentary perspective view of the envelope blank as it appears at the position shown in FIG. 25.

FIG. 28 is a fragmentary side sectional view similar to FIG. 26 and showing the saddle spreading mechanism at the position shown by the arrow 28 in FIG. 1.

FIG. 29 is a fragmentary side sectional view of the bottom gusset tucking and folding mechanism as the envelope advances from the position shown in FIG. 28.

FIG. 30 is a side sectional view of the bottom gusset folding and tucking mechanism in a further advanced position of the envelope blank.

FIG. 31 is a fragmentary perspective view of the envelope per se as it appears in the position shown in FIG. 30.

FIG. 32 is a fragmentary side sectional view of the envelope blank in a still further advanced position preliminary to folding over of the front panel.

FIG. 33 is a fragmentary side sectional view of the envelope blank is still further advanced position as the front panel is being folded toward the back panel.

FIG. 34 is a fragmentary side sectional view of the envelope in still further advanced position as the front panel is being folded into adhesive engagement with the back panel.

FIG. 35 is a perspective view of the envelope per se as it appears in FIG. 34.

Figures 1, 2, 3, 3A:
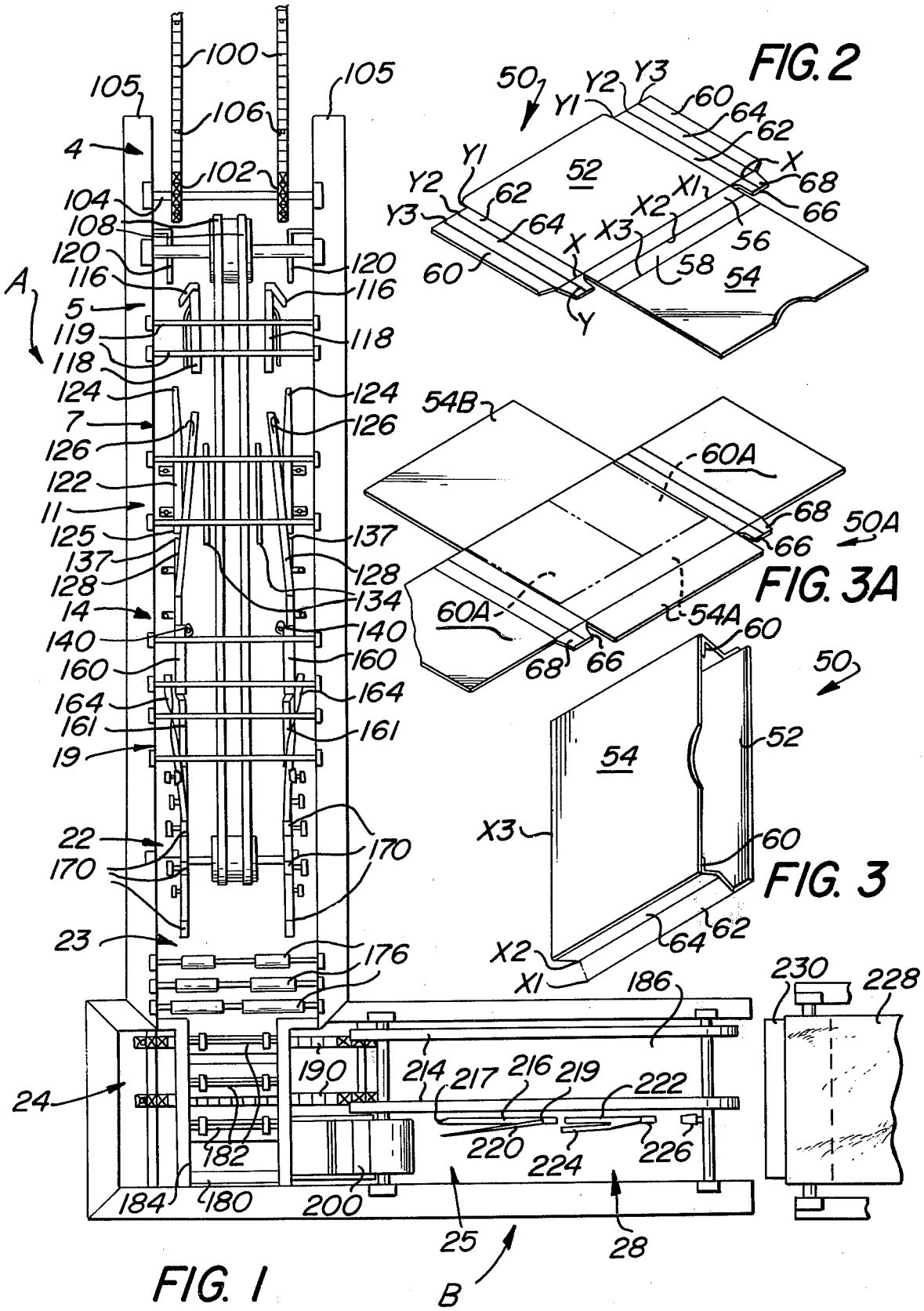
FIG. 1 is a plan view of an expansible gusset envelope fabricating machine embodying this invention.
FIG. 2 is a plan view of a preferred envelope blank which is adapted to be formed by the apparatus and method of this invention.
FIG. 3 is a perspective view of the completed envelope formed from the blank of FIG. 2.
FIG. 3A is a perspective view of a center-seam mailing envelope blank which is adapted to be formed by this invention, the completed mailer being shown in phantom lines.

Referring now to the drawings in which similar reference characters refer to similar parts, a preferred type of expansible envelope with which the present invention is concerned is shown in blank form 50 in FIG. 2 and in made-up fabricated form in FIG. 3. The blank 50 has a first portion 52 which will constitute the back panel of the envelope and a second portion 54 which will ultimately constitute the front panel. The front panel 54 is hinged to the back panel 52 along transverse triple score lines X1, X2, and X3 between which are defined a pair of bottom gusset sections 56 and 58 that comprise a collapsible bottom wall. A sealing flap 60 is hinged to the lateral edges of the back panel 52 along longitudinally extending triple score lines Y1, Y2 and Y3 which define a pair of side gusset sections 62 and 64 that comprise side walls in the completed envelope. Corner gusset tabs 66 and 68 are hinged to each of the side gusset sections 62 and 64 along extensions X of the first transverse score line X1, and diagonal score lines Z are formed in the lower portion of each of the side gusset sections 62 and 64 to define isosceles triangles whose apices point oppositely from the tabs 66 and 68. The tabs 66 and 68 are hinged to each other along an extension Y of the medial longitudinal score Y2 but the tab pairs are detached from the next adjacent bottom gusset sections. When the blank 50 is completed by means of the instant invention, the front panel 54 is folded into overlying disposition with the back panel 52 and glued to the sealing flaps 60. In addition, the corner tabs 66 and 68 are glued to the outer margins of the bottom gusset sections 56 and 58 while all gussets are interiorly folded in collapsed disposition.

The details of the foregoing blank 50 are fully shown and described in my prior U.S. patent application, Ser. No. 603,400, filed Aug. 11, 1975, such design being commmonly referred to as a full panel filing envelope.

The present invention is also adapted to produce a center seam style mailing envelope of the type shown in U.S. Pat. No. 3,414,185. The latter type mailing envelope is illustrated in FIG. 3A wherein elongated flaps 60A overlap each other at their edges upon completion of operations while a shortened panel 54A is glued to the lower margins of the overlapped flaps 60A to form a back flap with a center seam. In this case, panel 52 is the front panel, sealing flaps 54B acting as an enclosure for mailing. In all other respects, the mailer 50A follows the design of blank 50 wherein corner tabs 66 and 68 depend from the side gussets 62 and 64, said tabs being crimped to define corner gussets with saddle extensions.

The instant invention is likewise adapted to fabricate a side seam envelope (not shown) of the general style set forth in U.S. Pat. No. 3,552,640. Also within the comtemplation of the present invention is the fabrication of a side and bottom gusset envelope wherein the tabs extend outwardly from the bottom gusset sections and said tabs being crimped for nesting engagement within the side gussets, the essential attributes of this invention being the tab configuration and the crimping of said tabs into saddles which bridge the next adjacent gusset section so that all gussets are interiorly folded with closed corners at the completion of operations.

Referring to FIG. 1, the apparatus of the present invention comprises a frame of generally L-shaped plan configuration having a first section A in which the envelope blank is folded inwardly, next outwardly, and then inwardly along the longitudinal score lines Y1, Y2 and Y3, and a second section B in which the blank is folded inwardly, next outwardly and then inwardly along the transverse score lines X1, X2 and X3. The first section A includes a station for crimping the corner tabs 66, 68 so that they define saddles into which the bottom gussets 56, 58 are to be nested. See FIGS. 14 to 17. The second or transfer section B includes a glue application station (see FIGS. 25 and 26) and a station in which the bottom gussets are tucked into the saddles in adherent disposition.

Referring now to FIG. 4, the envelope blanks 50 are successively fed into the first section A by means of a pair of spaced chains 100 arranged in continuous loops around sprockets 102. The sprockets 102 are keyed to drive shafts 104 which are rotatably supported in frame side members 105 and driven by suitable motor and pulley drive unit in a conventional manner (not shown). Dogs 106 projecting at longitudinally spaced intervals along the chains 100 catch the rear edge of the envelope blanks 50 from a stack held in a suitable dispenser (not shown) and deposit each blank between upper and lower centrally disposed feed belts 108 and 110. The belts 108 and 110 are carried on pulleys 109 and 111 which are mounted on shafts journaled in the frame members 105 and driven by the same system as the chains 100.

The feed belts 108 and 110 grasp the medial portion of the blanks 50 and transport them individually along section A with the tabs 66 and 68 oriented forwardly and the longitudinal lines Y1, Y2 and Y3 oriented parallel to the path of travel. Horizontal plattens 112 are spaced on each side of the feed belts 108 and 110 to form a table during conveyance of the blanks through the machine section A and in addition support the various bending and creasing mechanisms.

Referring now to FIGS. 5 and 6, a curling toe 114 upstands from the platten 112 directly in the path of travel of the tabs 66 and 68, each toe 114 being adapted to roll the oncoming tabs into engagement with a pointed pick member 116. The pick members 116 are suspended from brackets 118 which are held by rods 119 in spaced disposition above the plattens to allow free passage of the panel portions 52 and 54 of the envelope blank therebetween. As the tabs 66 and 68 are rolled upwardly by the curling toes 114, the picks 116 catch the leading edge of the tabs and bend them backwardly along fold lines X, the latter being in alignments with the first transverse fold line X1. Upper guide fingers 120 are spaced just above the plattens 112 and hold down the flaps 60 as they trail the tabs through the curling toe 114 and picks 116. The forward sloping edge 118A of the brackets 118 meanwhile maintain control of the envelope blank body portion and urge the panels 52 and 54 into generally flat disposition against the plattens 112.

Referring now to FIGS. 7, 8 and 9, interposed in the path of travel of the flap 60 is a folding blade 122 having a flat pointed horn 124 at its leading edge which engages under the flaps. Then, as the blank 50 is conveyed through section A above the plattens 112, the horn 124 progressively widens and thickens whereby the blade 122 gently curls the lateral portion of the blank upwardly. The blade 122 has a flattened tail 125 which is spaced above the platten 112 so that a crease is formed along the first longitudinal score line Y1 as it passes under the tail.

As the entire side wall portion 60, 62, 64 is urged in a plane by the blade 122 toward the back panel 52 about longitudinal score line Y1, a bumper 126 intercepts the tabs 66, 68 and forces them backwardly against the lower margins of the side gusset sections 62 and 64. In addition, the bumper 126 tends to force the planar side wall 60, 62, 64 upwardly away from the back panel 52. The bumper 126 is mounted on a guide rail 128 which merges with the tail 125 of blade 122. The guide rail 128 is of angular configuration (sidewise Vee-cross section), as best shown in FIGS. 9 or 12, and after the slanting leading portion of this rail converges with blade 122, the trailing portion of guide rail 128 runs in line with the tail 125 of the blade 122.

Figure 11:
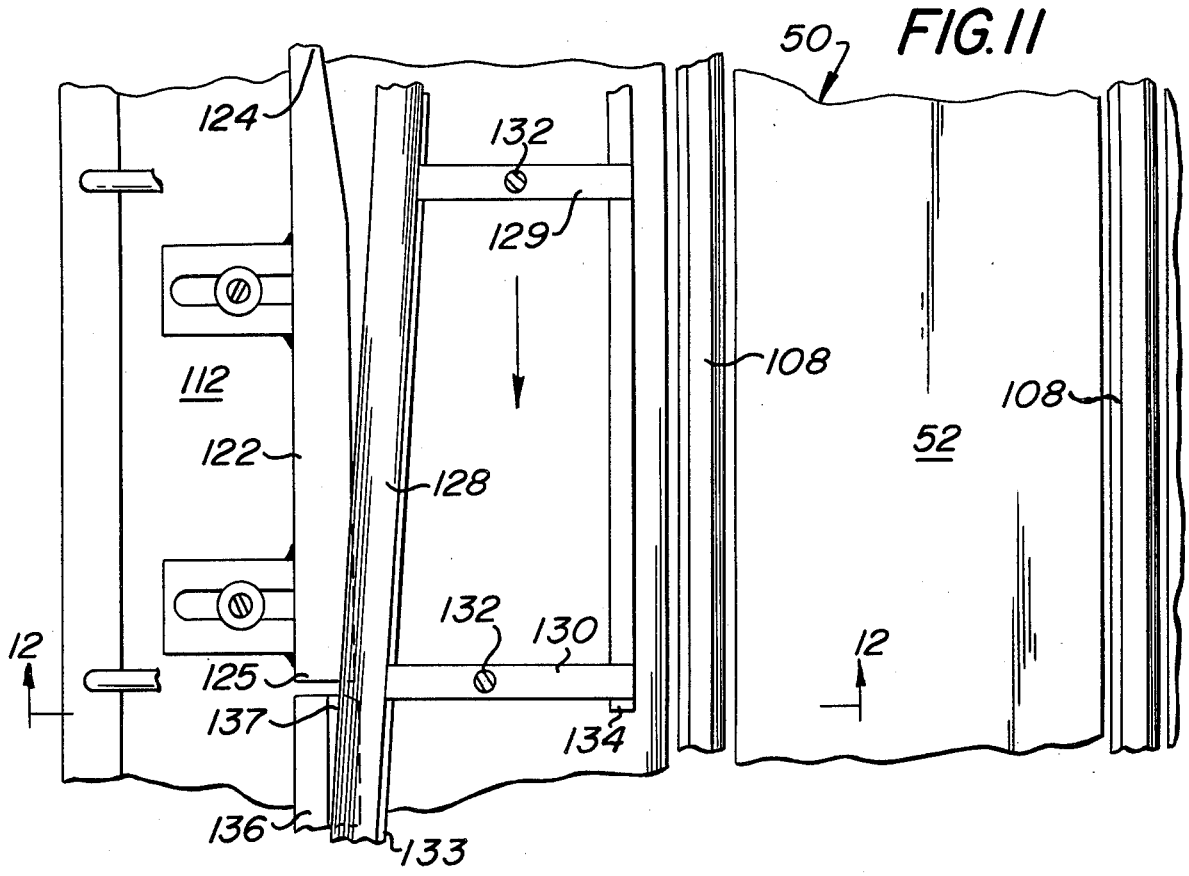
FIG. 11 is a fragmentary plan view taken generally at the position designated by the arrow 11 in FIG. 1 and showing the mechanism for making a second fold in the side gusset.
Figure 12:
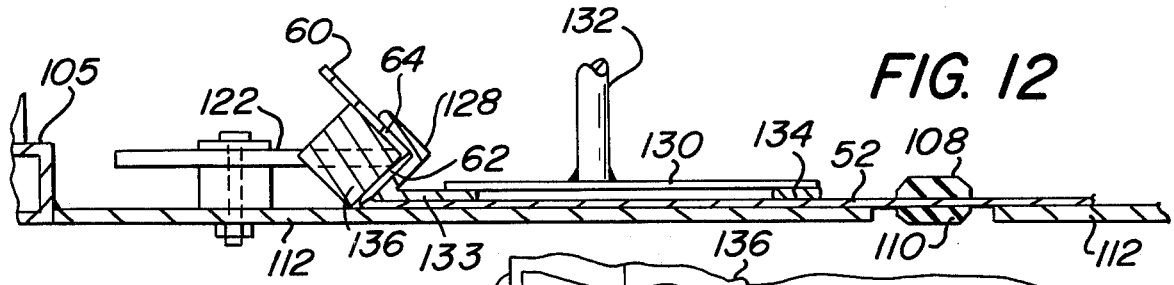
FIG. 12 is a sectional view taken along lines 12—12 of FIG. 11.

Referring next to FIGS. 11 and 12, the rail 128 is suspended above the platten 112 by cross beams 129 and 130, the latter being coupled to the frame rails 105 through bridge posts 132. An outboard hold-down shoe 133 is formed on the bottom of the trailing portion of rail 128 and is so spaced above the platten 112 as to maintain the outer margins of the panels 52 and 54 in sandwiched disposition therebetween during conveyance of the blanks via belts 108 and 110. Similarly, longitudinally extending sole plates 134 are affixed to the inboard ends of cross beams 129 and 130 to slidably sandwich the central portion of the blanks in controlled attitude.

Figure 13:
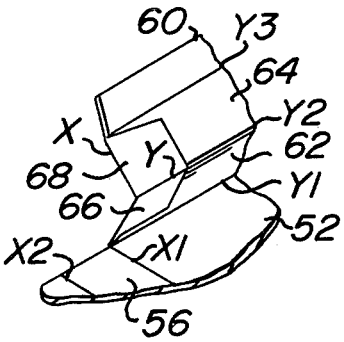
FIG. 13 is a fragmentary perspective view of the envelope blank per se as it is formed in FIG. 12.

Inserted within the trailing portion of rail 128 is an elongated rib 136. The rib 136 has a diamond sectional shape which is spaced within the rail "Vee" in complementary disposition. The forward end of the rib has a flattened nose 137 adjacently spaced from the tail 125 of blade 122. As the leading edge of the blank's side walls emerge from under the tail 125, the nose 137 of rib 136 forces the side gusset sections 62 and 64 together with the folded back tabs 66 and 68 into the channel between the rib and the rail so that said tab and side gusset sections are folded along lines Y and Y2, as shown in FIG. 13. That is, the side gusset sections 62 and 64 are partially inwardly folded and the tabs 66 and 68 are similarly inwardly folded in overlying disposition therewith.

Figure 14:
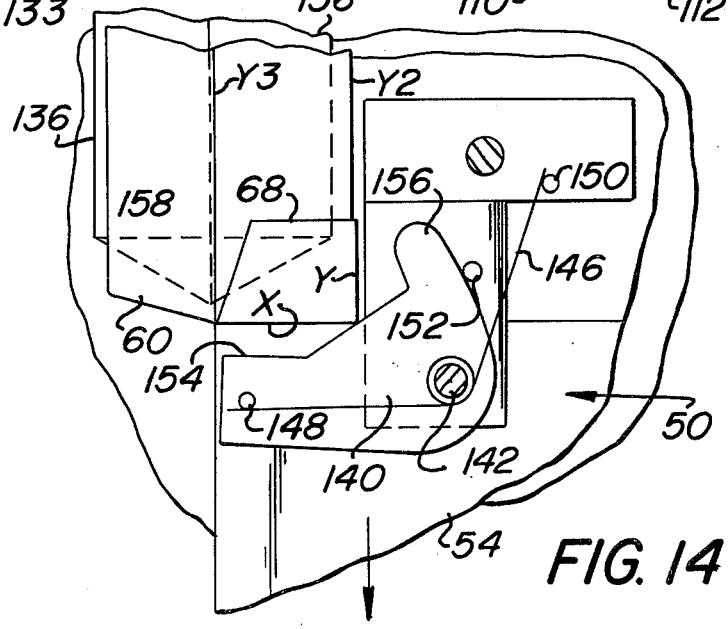
FIG. 14 is a fragmentary plan view taken generally at the position designated by the arrow 14 in FIG. 1 and showing the corner gusset crimping mechanism of this invention.

After the blank 50 has been inwardly folded along lines Y1 and outwardly folded along lines Y2, it is transported by the belts 108 and 110 to the tab crimping station where the tabs are inwardly crushed along lines Y and the triangular fold lines Z outwardly broken into the configuration shown in FIG. 18. Referring to FIGS. 14, 15, 16 and 17, the crimping mechanism includes a cam 140 which is rotatably supported on a shaft 142. The shaft 142 projects upwardly from a pedestal 144 which is affixed to platten 112 so that the cam 140 is in line with the score line Y2 as the side gussets 62 and 64 emerge from the channel between the rail 128 and rib 136. A spring 146 having free ends engaging cam pin 148 and pedestal pin 150 is coiled about the shaft 142 and biases the cam 140 clockwise, as shown in FIG. 14, into abutment with stop 152. In this position, lobe 154 on the end of cam 140 intercepts the leading edge of the side walls 62, 64 along the now folded line X hinging the tabs to the side gussets. As the blank 50 is conveyed along its longitudinal path, abutment of the leading edge X with lobe 154 causes the cam to rotate counterclockwise so that pawl 156 is forced against line Y. This action breaks the tabs inwardly toward each other and, at the same time, crimps the triangular gussets Z into notch 158 at the downstream end of rib 136. Note that the notch 158 is of V-shaped configuration whereby the lines Y between the tabs 66, 68 become oriented generally perpendicular to the line of travel of the blanks through the machine so that they define inwardly projecting saddles, as shown in FIG. 18.

Referring now to FIGS. 17 and 18, a sloping prow 160 is suspended in line with the advancing partially collapsed side walls. The prow 160 forces the side gusset sections 62 and 64 into abutment with each other and against the lateral margins of the rear panel 52. As the prow 160 becomes horizontally disposed, it becomes a pressure rail at 161 to iron the side gusset sections 62 and 64 together against the lateral edges of the rear panel 52. However, the flaps 60 protrude outwardly from the pressure rail 161 preliminary to folding said flaps 60 inwardly along longitudinal score line Y3.

Referring next to FIGS. 19, 20 and 21, a belt 164 traveling at the same linear speed as the blank 50 is fed under the flap 60 from below the platten 112. The belt 164 which is horizontal when it engages under the flap 60 is then turned through 180° by way of a series of rollers 168. After the belt 164 has completed its rotation, what was formerly the upper surface becomes now downwardly directed so as to press the flap 60 against the upper surface of rail 161. When the rollover of the flap 60 has been completed, i.e., inwardly folded about longitudinal score line Y3, the pressure rail 161 terminates. Then, a series of rollers 170 maintain the belt horizontally disposed but inverted and press the now sandwiched flap 60, side gussets 62 and 64, and back panel 52 together against a lower conveyor belt 172, as shown in FIG. 22. The belts 164 and 172 act in concert with each other to transport the blanks to a plurality of ironing cylinders 176 and 178 wherein the gussets 62, 64, the flaps 60 and the tabs are firmly pressed about their respective fold lines. See FIG. 23.

Referring now to FIGS. 24 and 25, the blanks 50 are delivered by the ironing rollers 176 and 178 into the transfer section B where the front panel 54 is carried against a stop 180. Flappers 182 resiliently depend at an angle from an overhead truss 184 which is supported above base plate 186 in the transfer section B. The flapper 182 urge each blank 50, including the already folded side gussets, downwardly against the base 186 while the blanks are being transferred from section A to section B (left to right as shown in FIG. 24). A pair of laterally spaced chains 190 carried by sprockets 192 are driven in a direction perpendicular to the conveying system of section A. The chains 190 incorporate longitudinally spaced dogs 194 which are synchronized with each blank deposited against stop 180 so as to transport the blanks in a direction which is parallel to the transverse score lines X1, X2 and X3 (i.e., downwardly into the plane of the paper as shown in FIG. 24 or from left to right as shown in FIG. 25).

The dogs push the blanks 50 below a longitudinally extending presser foot 198 which holds down panel 52 and its folded side gussets 62 and 64 while the panel portion 54 passes under a glue applicator roller 200. A pair of circumferentially spaced pads 202 and 204 longitudinally extend across the cylindrical surface of roller 200 and applies seams of adhesive 212 across the lateral margins of the bottom gusset sections 56 and 58 and the lateral margins of the front panel 54. See FIG. 27. The pads 202 and 204 are tangentially rotated against a glue transfer roller 206 which is in peripheral contact with glue pick-up roller 208 immersed in liquid adhesive carried in pot 210.

Referring now to FIGS. 25 and 26, upper and lower belts 214, similar to feed belts 108 and 110, transport the blanks 50 by transversely embracing the panels 52 and the folded flap and side gusset sections 60, 62 and 64 therebetween and carry the front panels 54 through and past the glue applicator 200. A bayonet blade 216 is suspended from support rod 218 directly in the path of travel of the corner gusset saddle extensions 66, 68. The bayonet 216 has a point 217 which pries open the saddle extensions while the body of the bayonet flares the saddles apart as each blank travels past. The bayonet 216 itself has a sidewise V-cross section similar in some respects to the guide rail 128 and acts in combination with a rib 220 to form creases along the transverse score lines X1 and X2.

Referring now to FIGS. 28, 29 and 30, the rib 220 slopes upwardly from the base platten 186 so as to raise the front panel 54 as it moves thereacross and also slants inwardly along the longitudinal path so as to push the bottom gusset sections 56 and 58 into the bight of the Vee in bayonet 216, whereby they are first inwardly folded along transverse fold X1 and then outwardly folded along transverse score line X2. See FIG. 31. As the partially folded bottom gusset sections 56 and 58 emerge from the Vee of the bayonet blade 216, the heel 219 of rib 220 tucks the bottom gussets into the saddles defined by the tabs 66 and 68.

Next, a longitudinally extending sole plate 222 catches the upper side of the bottom gusset section 58 as it emerges from the tail of bayonet 216 and presses the bottom gusset sections as well as the front panel 54 into flat disposition toward back panel 52 and against platten 186, as shown in FIG. 32. The sole plate 222 performs an identical function to the prow 160 and its pressure rail 161. Then, in a manner substantially similar to the flap turning belt 164 in section A, a tape 224 catches under the panel 54 (FIG. 32) and rolls through 180° by way of guide 225 and rollers 226 so as to invert the panel 54 about transverse score line X3 at the outer trailing edge of sole plate 222. See FIG. 33. As soon as the glued seams 212 are about to engage the side flaps 60, the sole plate 222 terminates and the tapes 224 press the underside of panel 54 such that its glued seams are abutted against the side flaps 60. See FIGS. 34 and 35.

Referring now to FIG. 1, a pair or wide belts 228 and 229 at the terminal end of the transfer section B press the front panel 54 into flat disposition with the back panel 52 while all gusset sections are in flattened inwardly collapsed disposition. The envelopes are then passed through a dryer (not shown) to cure the adhesive after which the completed envelopes are stacked for storage.

As is apparent from the foregoing description, the present invention is basically concerned with the method and apparatus for fabricating an expansible gusset envelope from a blank in which a pair of panels 52 and 54 are hinged to each other by bottom gusset sections 56 and 58 defined by transverse triple score lines X1, X2 and X3 in combination with flaps 60 hinged to the first panel 52 by side gusset sections 62 and 64 defined by longitudinal triple score lines Y1, Y2 and Y3. The tabs 66 and 68 which are hinged to the side gusset sections (but whichalso may be hinged to the bottom gusset sections) along a fold line X registering with the first transverse fold line X1 and hinged to each other along line Y registering with the medial longitudinal fold Y2 is adapted to be crushed into a saddle configuration such that the line Y becomes oriented generally transverse to the medial fold line Y2. At the same time, the triangular folds Z become outwardly disposed to form an isosceles triangle which comprises a closed gusset corner. At completion of the folding and glueing operations, all gussets are inwardly collapsed between the front and back panels.

Although this invention has been described in considerable detail, such description is intended as being illustrative rather than limiting, since the invention may be variously embodied without departing from the spirit thereof, and the scope of the invention is to be determined as claimed.

What is claimed is:

1. In a machine for fabricating an expansible gusset envelope from a blank having first and second panels hinged to each other along triple transverse fold lines defining inwardly collapsible bottom gusset sections therebetween, and flaps hinged to the sides of one of said panels along triple longitudinal fold lines defining inwardly collapsible side gusset sections therebetween, and including a tab hinged to each side gusset section with adjacent tabs hinged to each other along a line registering with the medial longitudinal fold line detached from the bottom gussets, apparatus comprising:

bending means for folding each of the side gusset sections inwardly with respect to each other, crimping means for crushing adjacent tabs along the line hinging them together to define inwardly directed corner gusset saddles at each side with the hinge line thereof oriented generally transverse to the medial longitudinal fold line, means for folding the bottom gussets inwardly with respect to each other, including means for tucking said bottom gussets in glued nested disposition within the corner gusset saddles, and means for folding said flaps and said other panel in glued disposition with respect to each other and in overlying disposition with respect to the first panel.

2. The apparatus of claim 1 including conveying means for transporting the blanks longitudinally with respect to the longitudinal fold lines during the inward folding of said side gusset sections.

3. The apparatus of claim 2 including second conveying means for transporting the blanks longitudinally with respect to the transverse fold lines during inward folding of said bottom gusset sections.

4. The apparatus of claim 2 wherein said crimping means comprises a cam interposed in the path of travel of said inwardly folded side gusset sections.

5. The apparatus of claim 2 including means to bend back each pair of tabs along the line hinging them to the side gusset sections.

6. The apparatus of claim 5 wherein said bending means comprises a longitudinally extending rail of sidewise Vee-cross section, a longitudinally extending rib having a cross section complementary with that of the rail and adjacently spaced therefrom to define a V-shaped channel therebetween, and blade means for directing the side gusset sections with their bent back tabs within said V-shaped channel.

7. The apparatus of claim 6 including a cam interposed in the path of travel of said side gusset sections as they emerge from said V-shaped travel.

8. The apparatus of claim 7 wherein said cam includes a finger which engages the leading edge of said side gusset sections along the line hinging the tabs thereto so as to effect rotation of said cam, and a pawl on said cam which crushes the tabs along the line hinging them together during rotation of said cam.

9. The machine of claim 8 wherein said rib includes a V-shaped notch at the downstream end thereof, said notch forming an angular wall for shaping triangular gusset corners in the side gusset sections when said tabs are crushed into saddle configuration by said cam.

10. The apparatus of claim 9 including ironing means to press said side gusset sections together.

11. The apparatus of claim 10 including ironing means to press said bottom gusset sections together with said saddles nested therein.

12. Apparatus for fabricating an expansible gusset envelope from a blank having first and second panels hinged to each other along first, second and third transverse fold lines which define inwardly collapsible bottom gusset sections therebetween, and flaps hinged to the sides of one of said panels along first, second and third longitudinal fold lines which define inwardly collapsible side panel sections therebetween, and including a tab hinged to each side panel section along a line registering with the first transverse fold line and hinged to each other along a line registering with the second longitudinal fold line, comprising:

conveying means for transporting the blanks longitudinally with the longitudinal fold lines, curling means for bending back the tabs along the line hinging them together, means for folding the flaps inwardly along the first longitudinal fold line, outwardly along the second longitudinal fold line, and inwardly along the third longitudinal fold line, crimping means for crushing said tabs and the underlying portion of the side panel sections along the line hinging the tabs together to define corner gusset saddles whose hinge line is generally transverse to the second longitudinal fold line, means for folding the other panel inwardly along the first transverse fold line, outwardly along the second transverse fold line and inwardly along the third transverse fold line so as to tuck the outer margins of the bottom gusset sections into nested engagement within the corresponding corner gusset saddles.

13. The apparatus of claim 12 including means for glueing said corner gusset saddles within said bottom gusset sections.

14. The apparatus of claim 13 including means for glueing said second panel and said flaps into overlying disposition with said first panel.

15. The apparatus of claim 12 wherein said crimping means comprises a cammed pawl interposed in the path of travel of the inwardly folded side panel sections.

16. The apparatus of claim 15 wherein said cammed pawl includes a lobe for engaging the side panel sections along the line hinging the tabs thereto so as to effect rotation of said cam, and a portion of said cam abutting the tabs along the line hinging them together during cam rotation.

17. A method for fabricating an expansible gusset envelope from a blank having first and second panels hinged together along triple transverse fold lines which define inwardly collapsible bottom gusset sections therebetween, and flaps hinged to the side of one of said panels along triple longitudinal fold lines which define inwardly collapsible side gusset sections therebetween, and tabs hinged to one of said gusset sections along a line hinging the other of said gusset sections to the first panel with adjacent tabs hinged to each other along a medial fold line detached from said other gussets, comprising the steps of:

a. folding the pair of gusset sections to which the tabs are hinged inwardly about the medial fold line thereof, b. bending back the tabs into overlying disposition with the adjacent portion of the gusset sections to which they are hinged, c. crimping the tabs along the line hinging them together to form a saddle having its fold line oriented transverse to the medial fold line in the underlying gusset section, including a triangular corner gusset in the underlying gusset section, d. folding the other of the gusset sections inwardly about the medial fold line thereof and tucking the other of said gusset sections into glued disposition with the saddles, and e. glueing the flaps and the other panel into adhesive disposition with each other so as to overlie the first panel with all gusset sections inwardly collapsed with closed corner gussets.

* * * * *